US011185131B1

(12) United States Patent
Lin

(10) Patent No.: US 11,185,131 B1
(45) Date of Patent: Nov. 30, 2021

(54) BUCKLE ASSEMBLY

(71) Applicant: Duraflex Hong Kong Limited, Hong Kong (CN)

(72) Inventor: Po Chu Lin, Taipei (TW)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 17/111,628

(22) Filed: Dec. 4, 2020

(51) Int. Cl.
*A44B 11/26* (2006.01)

(52) U.S. Cl.
CPC ..... *A44B 11/266* (2013.01)

(58) Field of Classification Search
CPC ..... A44B 11/266
See application file for complete search history.

(56) References Cited

U.S. PATENT DOCUMENTS 5,465,472 A * 11/1995 Matoba ..... A44B 11/266 24/625
5,791,026 A 8/1998 Anscher
D401,533 S 11/1998 Anscher
D425,443 S 5/2000 Anscher
6,311,374 B1 * 11/2001 Anscher ..... A44B 11/263 24/625
8,256,072 B2 9/2012 Kolasa et al.
2009/0178252 A1 * 7/2009 Yang ..... A44B 11/266 24/625

* cited by examiner

*Primary Examiner* — Robert Sandy
(74) *Attorney, Agent, or Firm* — Collard & Roe, P.C.

(57) ABSTRACT

A buckle assembly formed of a male buckle portion and a female buckle portion. The female buckle portion has a top wall, a bottom wall, side walls, and a cavity between the top wall and the bottom wall and a locking slot in each of the side walls. The male buckle portion has a base, two locking legs and two intermediate legs between the locking legs. The locking legs extend through the locking slots in the female portion, and locking pawls at the end of the locking legs engage the edges of the locking slots to secure the buckle portions together. The free ends of the locking legs are connected to the free ends of the intermediate legs by a retaining member, so that forces acting on the locking legs are transferred to the intermediate legs by the retaining members.

9 Claims, 3 Drawing Sheets

BUCKLE ASSEMBLY

BACKGROUND OF THE INVENTION

1. Field of the Invention

This invention relates to a two-piece buckle assembly for connecting two straps together. In particular, the invention relates to a buckle assembly having securing elements that prevent excessive outward flexing of legs of one of the buckle portions and add extra stability to the buckle portion.

2. The Prior Art

Two-piece side release buckles are normally formed of a male buckle portion and a female buckle portion. The male buckle portion generally has two locking legs that lock into locking slots on the female buckle portion. Often a central leg in the male portion adds stability to the assembly. In order to prevent the locking legs from being flexed outwardly beyond a certain point, U.S. Pat. No. 5,791,026 proposes to have flexible retaining members that connect the locking legs to the central leg, so that the locking legs cannot be flexed outwardly beyond the length of the retaining members. Additional variations of this type of buckle are also shown in U.S. Design Pat. Nos. D401,533 and D425,443.

The application of buckles is now expanding to diversified niche markets, and the tensile performance of the buckles is often the main factor for consumers to evaluate during purchasing. With rising environmental awareness, environmentally-friendly plastic materials are drawing attention, but their physical properties cannot yet bear comparison with existing materials such as acetal (POM). The application of new materials to old designs has not achieved satisfactory results so far.

SUMMARY OF THE INVENTION

It is therefore an object of the invention to incorporate more load-bearing structures, so that when the product is pulled, there are more paths for stress to be shunted and transferred, so as to achieve higher load-bearing capability. Therefore, when material quality fluctuates or the performance of the material is poor, there is more room for fault tolerance. It is another object of the invention to provide a buckle assembly that can accommodate materials having a lesser performance without compromising convenience or forcing users to change decades-long usage habits.

The invention therefore relates to a buckle assembly formed of a male buckle portion and a female buckle portion, wherein the female buckle portion comprises a top wall, a bottom wall connected to the top wall by opposing side walls, with a cavity between the top wall and the bottom wall, an insertion opening, and a locking slot in each of the side walls. The male buckle portion is configured to be locked to the female buckle portion by inserting the male buckle portion into the insertion opening. The male buckle portion has a base, two locking legs, and two intermediate legs between the locking legs. Each of the locking legs is configured to extend through a corresponding one of the locking slots in the female portion when the male portion is inserted into the female portion, and locking pawls at the end of each of the locking legs engage the edges of the locking slots to secure the male buckle portion to the female buckle portion. The male buckle portion is released by pressing the locking pawls inward until they clear the edges of the locking slots, at which point the male buckle portion is forced out of the female buckle portion. A strap retaining bar can be connected to the end of the male portion to attach the male portion to a strap.

The buckle assembly according to the present invention is configured to allow the attachment of a strap to each of the buckle portions, so that attaching the buckle portions together connects the two straps. To accomplish this, each of the male and female buckle portions has at least one strap retaining bar connected thereto. The strap can be sewn closed around a single strap retaining bar, or can be wrapped around a double-bar arrangement so as to be adjustable.

Each of the locking legs are connected to the intermediate legs by a flexible retaining member, which can be formed as a connecting strap. The retaining members prevent the locking legs from being flexed outwardly beyond a predetermined point, as the locking legs cannot be flexed outwardly beyond the length of the retaining members. When normal inward force exerts on the two locking legs to release the male buckle portion from the female buckle portion, the flexible retaining members exert an inward force on the intermediate legs, which flex inwardly absorb some of the force, so that the force is distributed between the locking legs and the intermediate legs. This adds extra stability to the buckle, so that even inferior materials can be used without fear of breakage.

In addition, the intermediate legs add additional stability to the buckle in the locked state while under tension. Tension from straps attached to both the male and female portions causes the locking legs to move inwardly at the tip of the locking pawls due to the force of the edges of the locking slots of the female portion on the locking pawls, while causing the intermediate legs to bend outwardly due to the transfer of force from the retaining members to the intermediate legs.

In a preferred embodiment, the retaining members are attached to free ends of the locking legs and to the free ends of the intermediate legs. The attachment point on the intermediate legs is reinforced, as this point acts to transfer the force on the locking legs toward the intermediate legs. The reinforced attachment points are preferably in the form of buttons that extend outward from the plane of the male portion of the buckle. In a preferred embodiment, the female portion has a slot on one side, and the buttons extend through the slot when the male portion is locked inside the female portion. This adds extra stability under tension, as when the buckle portions are pulled in opposite directions under tension from straps, the intermediate legs flex outward and pull the buttons to the edges of the slot where they are fixed there, thus securing the two buckle portions together even more securely. The slot can be configured so as to allow the buttons to exit the slot when they are pressed inward sufficiently as the locking legs are pressed inward, to allow the male portion to exit the female portion.

A central leg can be disposed between the intermediate legs. The intermediate legs are preferably connected at their base to the central leg, thus adding even more stability to the intermediate legs. In one embodiment, the female portion has a guide element extending through a center of the female portion in the longitudinal direction, and the central leg has a guide groove that interacts with the guide element to guide the male portion into the proper alignment during insertion of the male portion into the female portion.

The retaining members are preferably integrally molded in one piece with the locking legs and intermediate legs, and are formed from the same material as the rest of the buckle assembly. The intermediate legs are preferably molded thin enough so as to flex inward upon receiving the pressing force from the retaining members when the locking legs are squeezed together and to flex slightly outward when the locking legs are pulled outward and when the buckle portions are under tension. The intermediate legs absorb some of the force that is exerted on the locking legs, both when the legs are pressed inward and pulled outward, as well as when the connected buckle portions are pulled in opposite directions during use.

In summary, the two intermediate legs, together with the flexible retaining members, can effectively prevent the legs of the male buckle from being excessively bent in any direction and being damaged. The intermediate legs absorb some of the force exerted on the locking legs when they are pressed together and pulled apart, as well as when the buckle portions themselves are under tension from a strap so that materials that are not generally used for buckle production can be used for this application. The new design improves the strength, stability and durability of the buckle.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
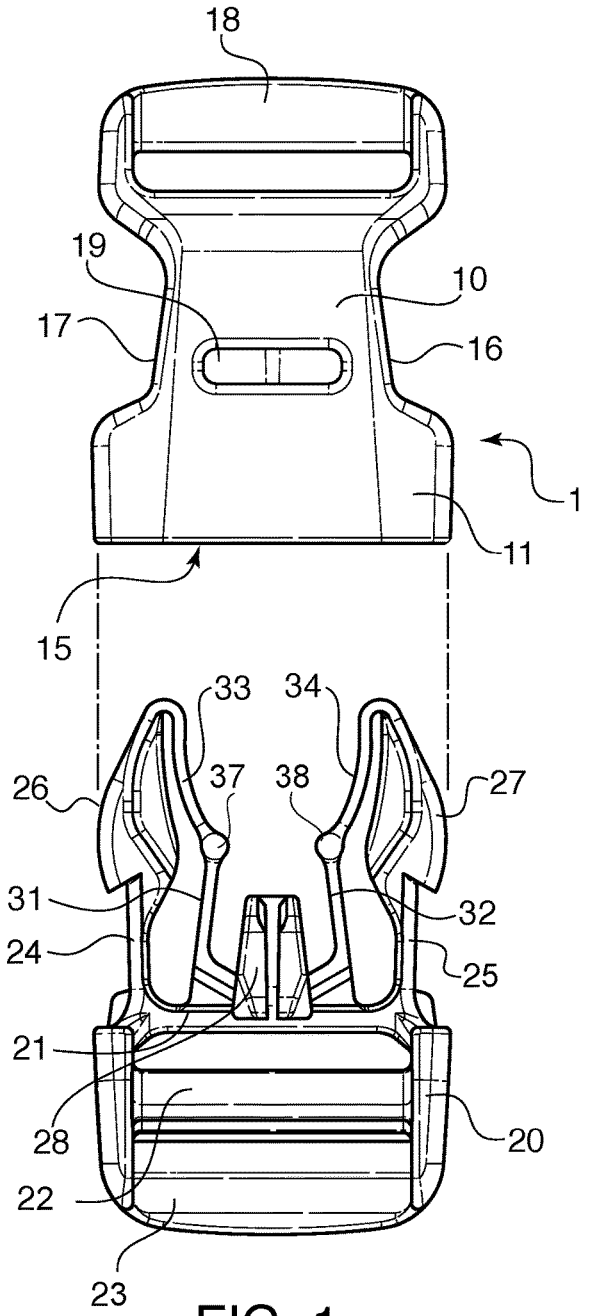
FIG. 1 shows an exploded front view of the buckle assembly according to the invention.
Figure 2:
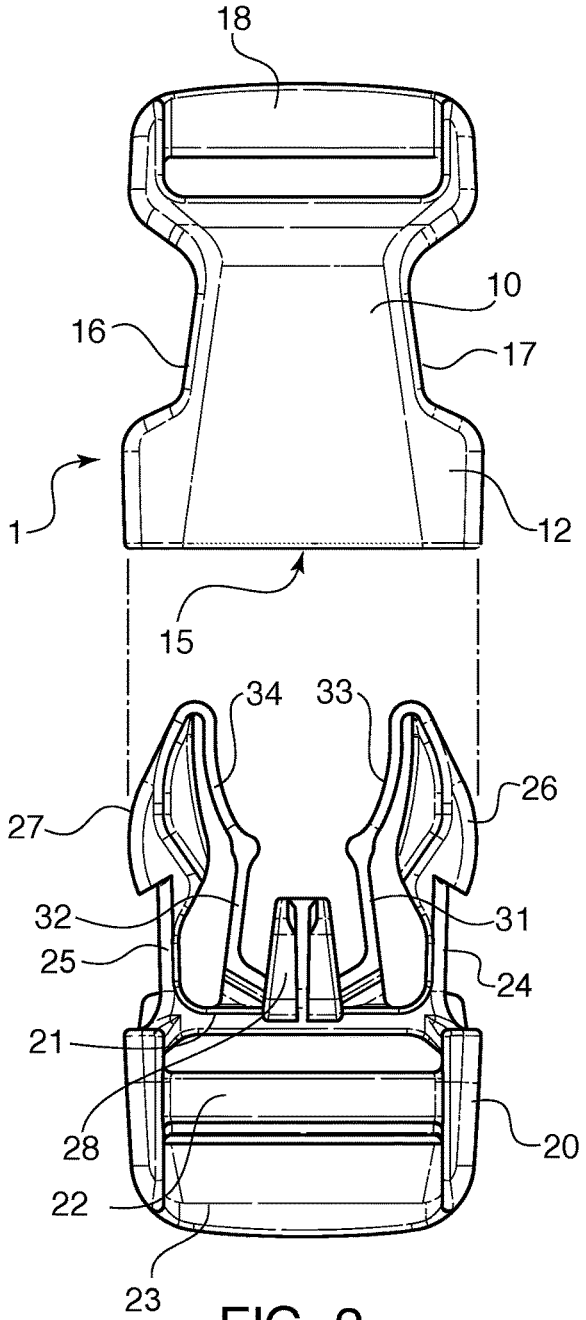
FIG. 2 shows an exploded rear view of the buckle assembly according to the invention.
Figure 3:
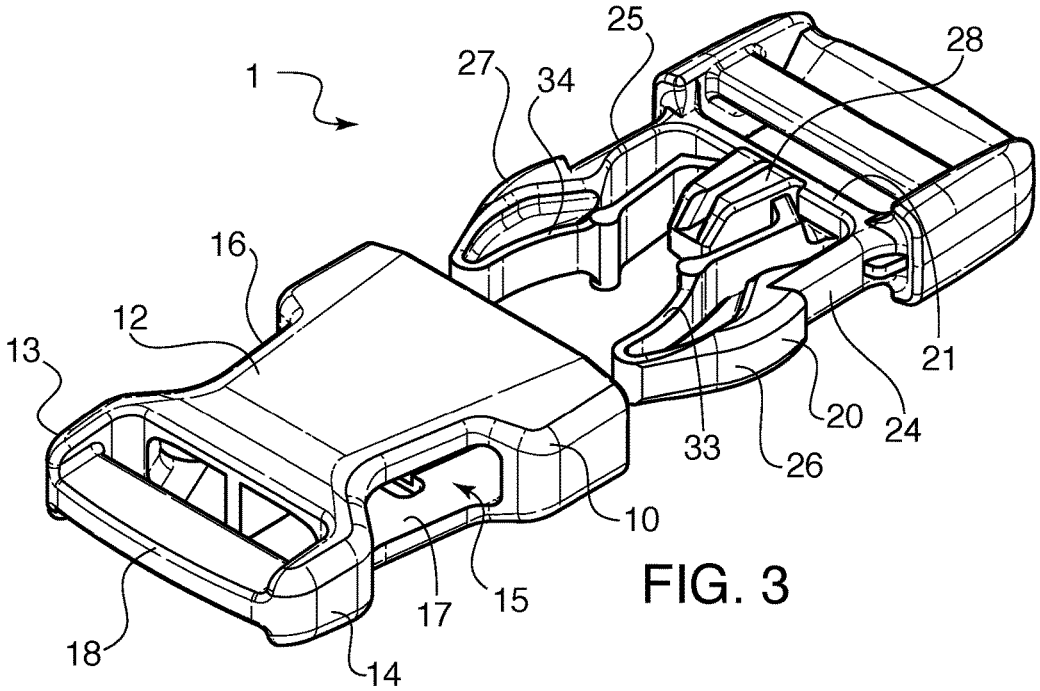
FIG. 3 shows an exploded perspective view of the buckle assembly according to the invention.

Referring now in detail to the drawings, FIGS. 1-4 show buckle assembly 1 according to the invention, which consists of female buckle portion 10 and male buckle portion 20. Female buckle portion 10 comprises a top wall 11, a bottom wall 12, and opposing side walls 13, 14. A cavity 15 extends between top wall 11 and bottom wall 12. Locking slots 16, 17 are disposed in side walls 13, 14 respectively. A strap retaining bar 18 is connected at an end of female buckle portion 10.

Male portion 20 is formed from a base 21 connected to strap retaining bars 22, 23, on one side, and to locking legs 24, 25 extending from the other side. Locking legs 24, 25 end in locking pawls 26, 27, which snap into locking slots 16, 17 in female buckle portion 10 when male buckle portion 20 is inserted into female buckle portion 10. Pressing locking pawls 26, 27 inwardly until they clear the edges of locking slots 16, 17 releases male buckle portion 20 from female buckle portion 10 by forcing male buckle portion 10 out of cavity 15.

Male buckle portion 20 has a central leg 28. In between central leg 28 and locking legs 24, 25 are disposed two intermediate legs 31, 32. Intermediate legs 31, 32 extend up from base 11 and are smaller than locking legs 24, 25, both in width and height. Intermediate legs 31, 32 tilt slightly inward so that they do not interfere with locking pawls 26, 27 when locking legs 24, 25 are pressed inward under strong forces.

Figure 7:
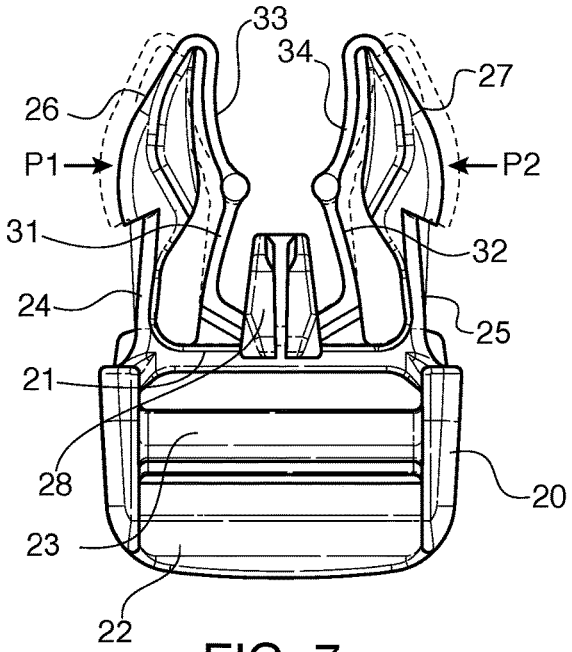
FIG. 7 shows a front view of the male portion in a state where locking legs are pressed inward.

Connected to intermediate legs 31, 32 are retaining members 33, 34. Retaining members 33, 34 are connected to intermediate legs 31, 32 at their tips via buttons 37, 38, and are connected to locking legs 24, 25 at the top of locking pawls 26, 27 on a side facing central leg 28. As shown in FIG. 7, inward pressure on locking pawls 26, 27 in the direction of arrows P1, P2 during insertion and release of male portion 20 from female portion 10 causes locking legs 24, 25 to bend inward and force flexible retaining members 33, 34 to exert an inward force on intermediate legs 31, 32, causing them to flex inward, which serves to distribute the forces on locking legs 24, 25 to stabilize locking legs 24, 25 and prevent excessive inward motion that might damage the buckle portion. Outward pressure on locking legs 24, 25 is compensated by flexible retaining members 33, 34, which only allow outward flexing up to a predetermined amount, due to the length and rigidity of the material of the retaining members 33, 34. Outward pressure on locking legs 24, 25 also causes intermediate legs 31, 32 to flex outward as well, to absorb some of the force. Retaining members 33, 34 are integrally molded in one piece with intermediate legs 31, 32 and locking pawls 26, 27 and are molded thin enough so as to allow locking legs 24, 25 to flex in the inward direction, and in the outward direction but in a limited manner.

Figure 4:
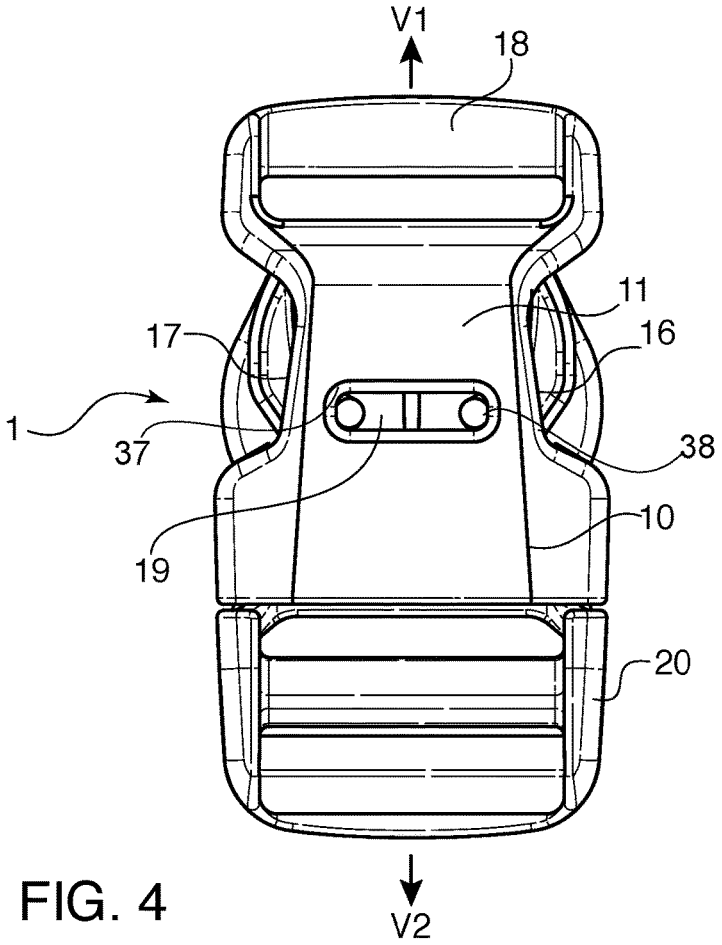
FIG. 4 shows a top view of the buckle assembly in a connected state.
Figure 5:
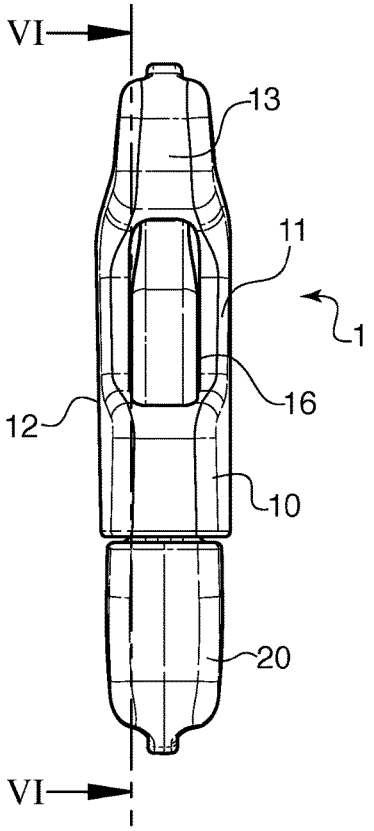
FIG. 5 shows a side view of the connected buckle assembly.
Figure 6:
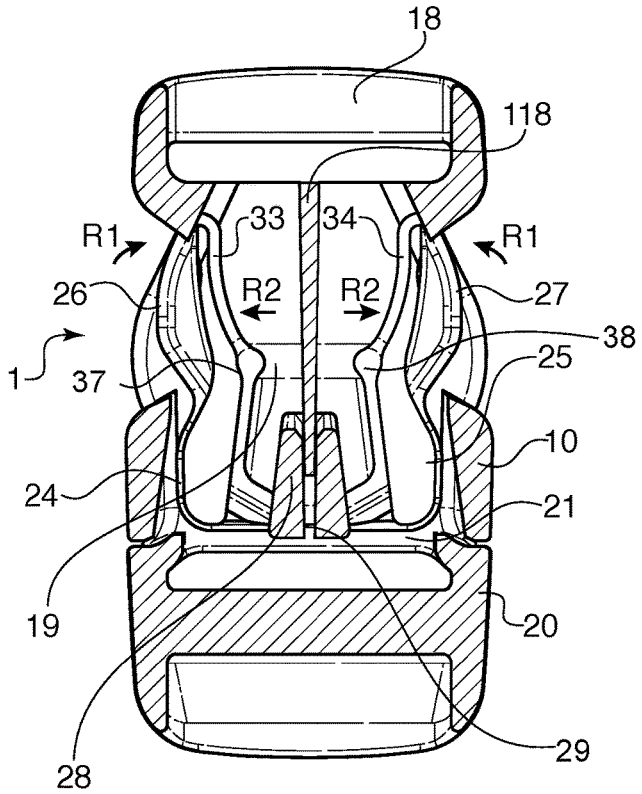
FIG. 6 shows a cross-sectional view along lines VI-VI of FIG. 5.

As shown in FIGS. 1, 4 and 6, female portion 10 has a slot 19 in its front surface. When male portion 20 is inserted into female portion 10, buttons 37, 38 extend through slot 19. When tension is applied to portions 10, 20 along arrows V1, V2, the edges of locking slots 16, 17 press against the bottom of locking pawls 26, 27 and cause them to rotate inward (see arrow R1 in FIG. 6). This inward rotation causes the top of retaining members 33, 34 to move inward, while the bottom of retaining members, upon downward pressure from locking pawls 26, 27, moves outward (arrow R2), causing intermediate legs 31, 32 to flex outward as well. The outward flexing of intermediate legs 31, 32 moves buttons 37, 38 to opposite ends of slot 19, where they remain wedged under tension, thus further securing male portion to female portion.

As shown in FIG. 6, central leg 28 has a central slot 29, which cooperates with guide element 118 which is in the form of a protruding ridge in female portion 10 when the two portions are connected together, so that male portion 20 is guided in proper alignment in female portion 10 during insertion.

Accordingly, while only a few embodiments of the present invention have been shown and described, it is obvious that many changes and modifications may be made thereunto without departing from the spirit and scope of the invention.

What is claimed is:

1. A buckle assembly comprising:

a female buckle portion comprising a top wall, a bottom wall connected to the top wall by opposing side walls, with a cavity between the top wall and the bottom wall, and a locking slot in each of the side walls;

a male buckle portion configured to be locked to the female buckle portion by inserting the male buckle portion into the cavity, the male buckle portion comprising a base, two locking legs, and two intermediate legs arranged between the two locking legs, wherein each of the locking legs is configured to extend through a corresponding one of the locking slots in the female portion when the buckle portions are locked together, wherein each one of the locking legs is connected to an adjacent one of the intermediate legs by a retaining member, and wherein pressing the locking legs inward causes the retaining members to exert an inward force on the intermediate legs and cause the intermediate legs to bend inward, and wherein when the buckle portions are locked together, tension on the buckle portions in opposite directions causes forces the locking legs to move in an inward direction, and pulls the intermediate legs in an outward direction.

2. The buckle assembly according to claim 1, further comprising a central leg disposed between the two intermediate legs.

3. The buckle assembly according to claim 2, wherein the intermediate legs are connected to the locking legs at free ends of each of the intermediate legs and locking legs.

4. The buckle assembly according to claim 2, wherein the central leg has a guide groove, wherein the female buckle portion has a guide element formed in the top wall or in the bottom wall, and wherein the guide element extends into the guide groove when the male portion is inserted into the female portion to align the male portion within the female portion during insertion of the male portion into the female portion.

5. The buckle assembly according to claim 1, wherein the retaining members are connected to the intermediate legs at reinforced attachment points.

6. The buckle assembly according to claim 5, wherein each one of the reinforced attachment points is formed as a button that extends beyond a plane of the male buckle portion.

7. The buckle assembly according to claim 6, further comprising a slot in the top wall of the female portion, wherein the buttons extend through the slot when the male portion is connected to the female portion, and wherein when the male and female portions are connected together and tension is applied to the male and female portions in opposite directions, the buttons are pulled to opposite ends of the slot.

8. The buckle assembly according to claim 1, wherein the retaining members are integrally molded in one piece with the locking legs and intermediate legs.

9. The buckle assembly according to claim 1, wherein the locking legs terminate in locking pawls that extend through the locking slots and overlap edges of the locking slots, and wherein tension on the buckle portions in opposite directions forces the edges of the locking slots to press against the locking pawls, causing the locking pawls to rotate inward.

* * * * *